US009218757B2

(12) United States Patent
Min et al.

(10) Patent No.: US 9,218,757 B2
(45) Date of Patent: Dec. 22, 2015

(54) LIQUID CRYSTAL DISPLAY DEVICE INCLUDING COMMON VOLTAGE COMPENSATING CIRCUIT

(71) Applicant: LG Display Co., Ltd., Seoul (KR)

(72) Inventors: WoongKi Min, Gyeonggi-do (KR); HongSung Song, Gyeonggi-do (KR); YoonSan Park, Gyeonggi-do (KR); SangJun Lee, Seoul (KR); SungGon Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 129 days.

(21) Appl. No.: 13/729,251

(22) Filed: Dec. 28, 2012

(65) Prior Publication Data

US 2014/0028535 A1 Jan. 30, 2014

(30) Foreign Application Priority Data

Jul. 24, 2012 (KR) ..... 10-2012-0080844

(51) Int. Cl.
*G09G 3/18* (2006.01)
*G09G 3/36* (2006.01)

(52) U.S. Cl.
CPC ..... *G09G 3/18* (2013.01); *G09G 3/3655* (2013.01); *G09G 2300/0426* (2013.01); *G09G 2320/0209* (2013.01); *G09G 2320/0223* (2013.01)

(58) Field of Classification Search
None
See application file for complete search history.

(56) References Cited

U.S. PATENT DOCUMENTS

| | | | | |
|---|---|---|---|---|
| 5,841,410 | A | 11/1998 | Oda et al. | |
| 2005/0253836 | A1* | 11/2005 | Kim et al. | 345/212 |
| 2006/0244704 | A1* | 11/2006 | JaeHun | 345/92 |
| 2007/0002005 | A1* | 1/2007 | Kim et al. | 345/103 |
| 2007/0024565 | A1 | 2/2007 | Choi | |
| 2008/0303770 | A1* | 12/2008 | Oke et al. | 345/92 |
| 2009/0135124 | A1* | 5/2009 | Nakatsuka | 345/94 |
| 2010/0053056 | A1 | 3/2010 | Lee et al. | |
| 2010/0110058 | A1* | 5/2010 | Moh et al. | 345/211 |

FOREIGN PATENT DOCUMENTS

| | | | |
|---|---|---|---|
| CN | 1854823 | A | 11/2006 |
| CN | 101727866 | A | 6/2010 |

OTHER PUBLICATIONS

European Search Report for Application No. 12192734.7 dated Oct. 11, 2013.
First Notification of Office Action dated May 6, 2015 from The State Intellectual Property Office of China in Chinese application No. 201210576012.X.

* cited by examiner

*Primary Examiner* — Joseph Haley
*Assistant Examiner* — Emily Frank
(74) *Attorney, Agent, or Firm* — Morgan, Lewis & Bockius LLP

(57) ABSTRACT

A liquid crystal display device may include: a liquid crystal display panel comprising a first and a second common voltage supply line formed in a first direction at both side ends of the substrate, and at least one feedback line formed in the first direction and connected to the first common voltage supply line and/or the second common voltage supply line; and at least one common voltage compensating circuit, an output terminal of which is connected to the first and the second common voltage supply lines, and an input terminal of which is connected to the feedback line.

11 Claims, 9 Drawing Sheets

LIQUID CRYSTAL DISPLAY DEVICE INCLUDING COMMON VOLTAGE COMPENSATING CIRCUIT

This application claims priority to Korean Patent Application No. 10-2012-0080844, filed on Jul. 24, 2012, which is incorporated by reference herein in its entirety.

BACKGROUND OF THE INVENTION

1. Field of the Invention

The present invention relates to a common voltage compensating circuit in a liquid crystal display device, and more particularly, to a common voltage compensating circuit for implementing high resolution and high frequency, and enhancing common voltage signal deviation due to RC delay between wirings formed on a liquid crystal panel in a large-sized narrow bezel type liquid crystal display device, and a liquid crystal display device including the same.

2. Description of the Related Art

With the development of various portable electronic devices such as mobile phone, notebook computer, or the like, the requirement for flat panel display devices applied to those portable electronic devices has been gradually increased. For those flat panel display devices, studies on Liquid Crystal Display (LCD), Plasma Display Panel (PDP), Field Emission Display (FED), Organic Light Emitting Diodes (OLEDs), and the like have been actively carried out, but at present liquid crystal display (LCD) devices are primarily used because of their mass production technology, effective driving method, and high-definition and large-sized screen.

The liquid crystal display device is a device for controlling optical transmittance through an electric field formed on a liquid crystal capacitor in response to a data voltage input thereto to display an image, which is comprised of a liquid crystal display panel for implementing an image, and a drive circuit for driving the liquid crystal display panel.

FIG. 1 is a view illustrating an example of a typical liquid crystal display device.

As illustrated in the drawing, a liquid crystal display device in the related art may include a liquid crystal display panel 10 for displaying an image, a gate driving unit 20 and a data driving unit 30 for driving the liquid crystal panel 10, and a common voltage compensating circuit 50 for supplying a common voltage (Vcom) to the liquid crystal panel 10.

The gate driving unit 20 is mounted at a side end of the liquid crystal display panel 10, and the data driving unit 30 for providing a data voltage in a direction perpendicular to the gate driving unit 20 is mounted and attached to a Flexible Printed Circuit Board (FPCB) 35.

Furthermore, a plurality of gate lines (GLs) and data lines (DLs) are crossed with each other to define pixel regions at an inner side of the liquid crystal display panel 10, and a thin-film transistor (T) and a liquid crystal capacitor (LC) are formed at each pixel region.

The gate driving unit 20 sequentially supplies a gate driving voltage to the gate lines (GLs) for each horizontal period (1H) according to a plurality of gate control signals applied from a timing controller (not shown) mounted on a main printed circuit board (PCB) 40.

The data driving unit 30 supplies a data voltage (Vdata) to the pixel region through all data lines (DLs) for each horizontal period (1H) in response to a data control signal applied from the timing controller.

The common voltage compensating circuit 50 is to minimize the variation of a common voltage on the liquid crystal display panel 10 by applying a compensating circuit using inverting amplification thereto. The common voltage compensating circuit 50 continuously receives a common voltage (Vcom) fed back from the liquid crystal panel display 10 and outputs a common voltage (Vcom) compensated according to a compensation ratio, thereby constantly controlling a voltage level according to the variation of the common voltage (Vcom) generated on the liquid crystal panel display 10. The common voltage (Vcom) outputted from the common voltage compensating circuit 50 is applied to a common line (CL) formed on the liquid crystal panel display 10. A common voltage supply line (BL) connected to the common line (CL) is formed at a side end of the liquid crystal display panel 10, and the common voltage compensating circuit 50 is connected to the common voltage supply line (BL) through the output line (OL) formed on the FPCB 35 to supply a common voltage (Vcom) to the common line (CL).

Here, the common line (CL) supplies a common voltage (Vcom) to a first electrode of the foregoing liquid crystal capacitor (LC), and the data line (DL) applies a data voltage (Vdata) to a second electrode of the liquid crystal capacitor (LC), thereby implementing an image through an electric field between the two electrodes.

On the other hand, the foregoing common line (CL) is disposed adjacent to the gate line (GL) and data line (DL), and when a voltage level applied to the two lines (GL, DL) is abruptly changed, it causes distortion to the common voltage (Vcom) applied to the common line (CL) due to a parasitic capacitance therebetween and the like. It is a main cause of cross talk. In order to solve the problem, the common voltage compensating circuit 50 is typically configured with a structure in which a common voltage (Vcom) applied to the liquid crystal panel display 10 is fed back to control a common voltage (Vcom) level being outputted by reflecting the voltage level variation.

To this end, a common voltage feedback line (FL) for which ends thereof are connected to each other adjacent to the common voltage supply line (BL) is further formed on the liquid crystal panel display 10, and the varied common voltage (Vcom) is transferred to the common voltage compensating circuit 50 through the input line (IL) formed on the FPCB 35.

Here, the common voltage compensating circuit 50 may include an OP amplifier (not shown) for controlling the fed-back common voltage (Vcom) according to a resistance ratio, and the common voltage compensating circuit 50 outputs a common voltage (Vcom) to the output line (OL) through an output terminal of the OP amplifier, and the common voltage (Vcom) is fed back through an inverting (−) input terminal of the OP amplifier connected to the input line (IL) to control the output common voltage (Vcom), thereby minimizing image quality degradation.

Such liquid crystal display devices are tending toward high resolution and high frequency, and narrow bezel type, and the studies thereof have been carried out in the form of gradually decreasing a width of the common line (CL) within the liquid crystal panel display 10, and decreasing a gap between the common line (CL) and gate line (GL) and data line (DL) in order to obtain a high transmittance.

However, the level of distortion of the common voltage (Vcom) is increased as increasing an area of the liquid crystal panel display 10 as well as decreasing a width of the common line (CL), and particularly, in case of the common lines (CLs) formed on the liquid crystal panel display 10, a voltage level difference between the applied common voltages (Vcoms) due to RC delay according to the location electrically connected to the common voltage compensating circuit 50 is further increased compared to the related art. In other words, a large deviation may occur between the common voltages (Vcoms) on a portion connected to the common voltage supply line (BL) and a portion opposite thereto even on one common line (CL).

Furthermore, referring to FIG. 2, in case of a large-sized liquid crystal panel 10, it may be divided into three regions (A1-A3) from the top to the bottom, and connected to the common voltage compensating circuit 50 at a side end thereof, and thus when the common voltage (Vcom) is applied thereto, common lines on the upper region (A1) adjacent to the common voltage compensating circuit 50 according to the RC delay of the common line causes a small signal delay, but other common lines on the lower region (A3) causes a large signal delay.

As a result, when a voltage compensation ratio of the common voltage (Vcom) is adjusted based on any one region (A1), it may cause a problem that the other regions (A2, A3) cannot be set to a normal voltage level of the common voltage (Vcom) due to the deviation. It may be a main cause of horizontal cross talk.

SUMMARY OF THE INVENTION

The present invention is contrived to solve the aforementioned problem and an object of the invention is to provide a common voltage compensating circuit for improving a voltage level deviation of the common voltage (Vcom) due to RC delay between common lines in a large-sized liquid crystal display device to implement a high quality image, and a liquid crystal display device including the same.

Furthermore, another object of the present invention is to provide a common voltage compensating circuit for improving a voltage level deviation of the common voltage (Vcom) applied to the existing liquid crystal display panel without changing the structure of a common voltage supply line and a feedback line, and a liquid crystal display device including the same.

A liquid crystal display device according to an embodiment of the present invention may include a liquid crystal display panel comprising a first and a second common voltage supply line formed in a first direction at both side ends of the substrate, a third common voltage supply line formed in the first direction an end of which is connected to at least one of the first and the second common voltage supply line, and a feedback line formed in the first direction an end of which is connected to the remaining one of the first and the second common voltage supply line; a first common voltage compensating circuit disposed at a side end of the liquid crystal display panel, and an output terminal of which is connected to the other end of the first and the second common voltage supply line, and an input terminal of which is connected to the other end of the feedback line; and a second common voltage compensating circuit disposed at a side end of the liquid crystal display panel, and an output terminal of which is connected to the other end of the third common voltage supply line, and an input terminal of which is connected to the other end of the feedback line.

A liquid crystal display device according to another embodiment of the present invention may include a liquid crystal display panel comprising a first through a fourth common voltage supply line formed in a first direction at both side ends of the substrate, respectively, two for each side end, and a plurality of common lines formed in a second direction ends of which are connected to the second and the third common voltage supply line, respectively; and at least one common voltage compensating circuit disposed at a side end of the liquid crystal display panel, and an output terminal of which is connected to the other end of the first through the fourth common voltage supply line, and an input terminal of which is electrically connected to at least one of the common lines.

A liquid crystal display device according to still another embodiment of the present invention may include a liquid crystal display panel comprising a first through a fourth common voltage supply line formed in a first direction at both side ends of the substrate, respectively, two for each side end, and a plurality of common lines formed in a second direction, ends of which are connected to the second and the third common voltage supply line, respectively; and at least one common voltage compensating circuit disposed at a side end of the liquid crystal display panel, and an output terminal of which is connected to the other ends of the first through the fourth common voltage supply line, and an input terminal of which is electrically connected to a line disposed between the first and second common voltage supply lines and the third and fourth common voltage supply lines.

According to an embodiment of the present invention, according to the present invention, a common voltage compensation ratio may be differently applied according to a location at which a common line is disposed on the liquid crystal display panel, thereby obtaining an effect capable of providing a common voltage compensating circuit for improving image deterioration due to RC delay between common lines and implementing a high quality image, and a liquid crystal display device including the same.

Furthermore, only a connecting form between the common voltage compensating circuit and common voltage supply lines and feedback lines may be changed without changing a line structure on the liquid crystal display panel, thereby obtaining an effect capable of providing a common voltage compensating circuit for improving image deterioration due to RC delay between common lines as well as using the existing liquid crystal display panel as it is, and a liquid crystal display device including the same.

In various embodiments, a liquid crystal display device may include: a liquid crystal display panel comprising a first and a second common voltage supply line formed in a first direction at both side ends of the substrate, and at least one feedback line formed in the first direction and connected to the first common voltage supply line and/or the second common voltage supply line; and at least one common voltage compensating circuit, an output terminal of which is connected to the first and the second common voltage supply lines, and an input terminal of which is connected to the feedback line.

In various embodiments, the liquid crystal display device may further include a third common voltage supply line formed in the first direction an end of which is connected to at least one of the first and the second common voltage supply line, wherein the at least one feedback line is formed in the first direction and is connected to the other one of the first common voltage supply line and the second common voltage supply line.

In various embodiments, the at least one common voltage compensating circuit may be disposed at a side end of the liquid crystal display panel, the output terminal of which is connected to the other end of the first and the second common voltage supply line, and the input terminal of which is connected to the other end of the feedback line.

In various embodiments, the at least one common voltage compensating circuit may include a first common voltage compensating circuit and a second common voltage compensating circuit.

In various embodiments, an output terminal of the second common voltage compensating circuit may be connected to the other end of the third common voltage supply line, and an input terminal of the second common voltage compensating circuit may be connected to the other end of the feedback line.

In various embodiments, the first and the second common voltage compensating circuit may be set to have different voltage gains to each other.

In various embodiments, the first common voltage compensating circuit may include: a first input resistor; a first operational amplifier comprising an inverting input terminal connected to the first input resistor, a non-inverting input terminal to which a reference common voltage is applied, and an output terminal; and a second resistor disposed between the inverting input terminal and the output terminal, and the second common voltage compensating circuit comprises: a third input resistor; a second operational amplifier comprising an inverting input terminal connected to the third input resistor, a non-inverting input terminal to which a reference common voltage is applied, and an output terminal; and a fourth resistor disposed between the inverting input terminal and the output terminal.

In various embodiments, the liquid crystal display device may further include: a third common voltage supply line formed in the first direction an end of which is connected to at least one of the first and the second common voltage supply line; and a multiplexer an input terminal of which is connected to the feedback line, and a plurality of output terminals of which are connected to an input terminal of the common voltage compensating circuit and a selecting terminal of which is connected to a timing controller for selecting the output terminals in a 1/N (N is a natural number) frame period.

In various embodiments, the liquid crystal display device may further include a third common voltage supply line formed in the first direction an end of which is connected to at least one of the first and the second common voltage supply line, and a switching unit having N switches an end of which is connected to the feedback line, and the other end of which is connected to an input terminal of the common voltage compensating circuit to control an on/off operation thereof in 1/N (N is a natural number) frame period by a timing controller.

In various embodiments, the liquid crystal display device may further include a third and a fourth common voltage supply line formed in a first direction at both side ends of the substrate, respectively, one for each side end, and a plurality of common lines formed in a second direction ends of which are connected to the second and the third common voltage supply line, respectively; wherein an output terminal of the at least one common voltage compensating circuit is connected to the other end of the first through the fourth common voltage supply line, and an input terminal of the at least one common voltage compensating circuit is electrically connected to at least one of the common lines.

In various embodiments, the liquid crystal display device may further include a multiplexer an input terminal of which is connected to at least one of the common lines, and a plurality of output terminals of which are connected to an input terminal of the common voltage compensating circuit and a selecting terminal of which is connected to a timing controller for selecting the output terminals in a 1/N (N is a natural number) frame period.

In various embodiments, the liquid crystal display device may further include a switching unit having N switches an end of which is connected to at least one of the common lines, and the other end of which is connected to an input terminal of the common voltage compensating circuit to control an on/off operation thereof in 1/N (N is a natural number) frame period by a timing controller.

In various embodiments, the liquid crystal display device may further include a third and a fourth common voltage supply line formed in the first direction at both side ends of the substrate, respectively, one for each side end, and a plurality of common lines formed in a second direction, ends of which are connected to the second and the third common voltage supply line, respectively; wherein an output terminal of the at least one common voltage compensating circuit is connected to the other ends of the first through the fourth common voltage supply line, and an input terminal of the at least one common voltage compensating circuit is electrically connected to a line disposed between the first and second common voltage supply lines and the third and fourth common voltage supply lines.

In various embodiments, the liquid crystal display device may further include a multiplexer an input terminal of which is connected to an auxiliary line, and a plurality of output terminals of which are connected to an input terminal of the common voltage compensating circuit and a selecting terminal of which is connected to a timing controller for selecting the output terminals in a 1/N (N is a natural number) frame period.

In various embodiments, the liquid crystal display device may further include a switching unit having N switches an end of which is connected to the auxiliary line, and the other end of which is connected to an input terminal of the common voltage compensating circuit to control an on/off operation thereof in 1/N (N is a natural number) frame period by a timing controller.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a common voltage compensating circuit and a liquid crystal display device including the same according to a preferred embodiment of the present invention will be described with reference to the accompanying drawings.

Figure 3:
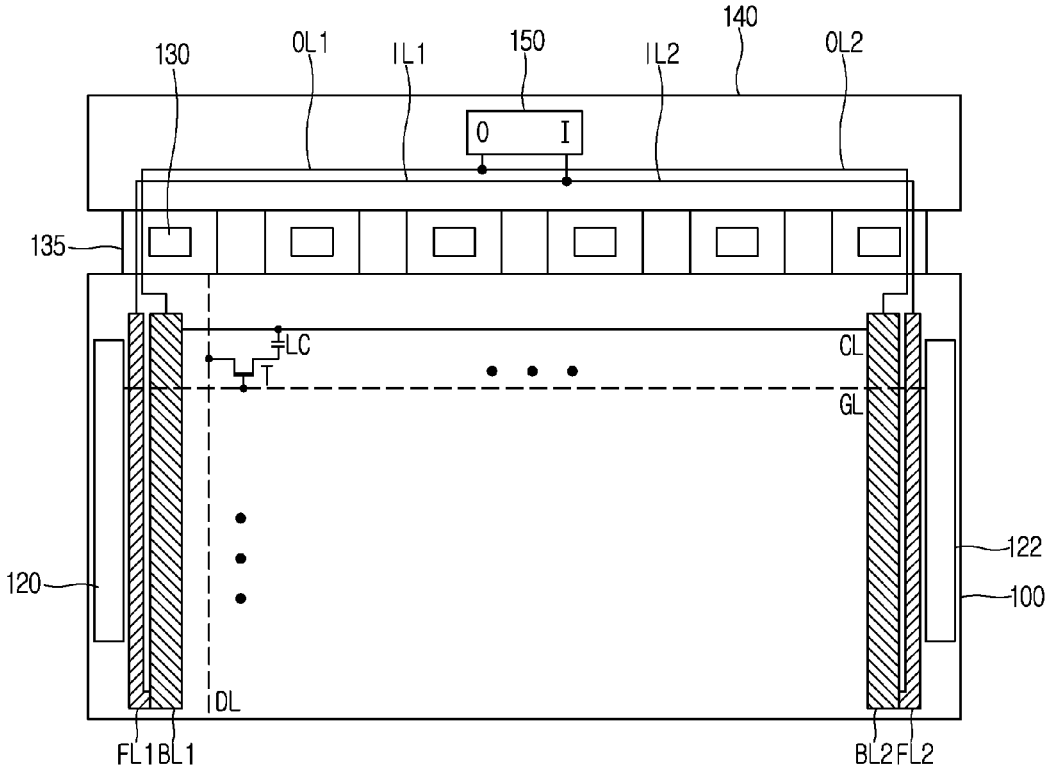
FIG. 3 is a view illustrating a liquid crystal display device including a common voltage compensating circuit according to a first embodiment of the present invention.

FIG. 3 is a view illustrating a liquid crystal display device including a common voltage compensating circuit according to a first embodiment of the present invention.

As illustrated in the drawing, a liquid crystal display device according to a first embodiment of the present invention may include a liquid crystal display panel 100 in which gate driving units 120, 122 are mounted at both side ends thereof and a first and a second common voltage supply line (BL1, BL2) and a first and a second feedback line (FL1, FL2) are formed thereon, a plurality of FPCBs 135 connected to a side end of the liquid crystal display panel 100 and mounted with a data driving unit 130, a main PCB 140 connected to the FPCB 135 in a direction opposite to the liquid crystal display panel 100, and a common voltage compensating circuit 150 mounted on the main PCB 140.

The liquid crystal display panel 100 is mounted with two gate driving units 120, 122 at both side ends thereof, respectively, one for each side end. It is to minimize a problem that charging and discharging of a gate driving voltage is delayed at the other side end due to a line resistance and thus a turn-on/off operation of the transistor, e.g. field effect transistor, e.g. thin-film transistor (T) in the relevant region cannot be normally carried out when the gate driving units 120, 122 are provided only at one side end of a large-seized liquid crystal panel 100.

Furthermore, a plurality of gate lines (GLs) and data lines (DLs) are crossed with each other to define pixel regions at an inner side of the liquid crystal display panel 100, and a thin-film transistor (T) and a liquid crystal capacitor (LC) are formed at each pixel region. Furthermore, a plurality of common lines (CLs) are formed in parallel to the gate lines (GLs).

The gate driving units 120, 122 sequentially supply a gate driving voltage to the gate lines (GLs) for each horizontal period (1H) according to a plurality of gate control signals applied from a timing controller (not shown) mounted on a main printed circuit board (PCB) 140. Here, a method in which the gate driving units 120, 122 are connected to the same gate line (GL) and thus gate driving signals are simultaneously output at the same timing or a method in which the first gate driving unit 120 outputs a gate driving signal during a first horizontal period (1H) and then the second gate driving unit 122 outputs a gate driving signal during the next horizontal period and thus gate driving signals are output in an alternate manner may be applied to each of the gate driving units 120,122.

The data driving unit 130 supplies a data voltage (Vdata) to the pixel region through all data lines (DLs) for each horizontal period (1H) in response to a data control signal applied from the timing controller. In other words, the data driving unit 130 applies a data voltage to the liquid crystal display panel 100 in synchronization with a gate driving voltage of the first gate driving unit 120 and second gate driving unit 122.

Here, though not shown in the drawing, the first gate driving unit 120, second gate driving unit 122, and data driving unit 130 are driven by a control signal applied from the timing controller (not shown), and the timing controller may be mounted at a side of the main PCB 140.

The common voltage compensating circuit 150 receives a power voltage (VDD) to generate a common voltage (Vcom) with a predetermined voltage level for driving the liquid crystal display panel 100. The common voltage (Vcom) is applied to the common line (CL) formed on the liquid crystal display panel 100. The first and the second common voltage supply line (BL1, BL2) connected to the common line (CL), and the first and the second feedback line (FL1, FL2) connected to ends of the first and the second common voltage supply line (BL1, BL2) are formed at both side ends of the liquid crystal display panel 100, and the common voltage compensating circuit 150 is electrically connected to the first and the second common voltage supply line (BL1, BL2) to apply the common voltage (Vcom) to the common line (CL), and the common voltage (Vcom) applied to the liquid crystal display panel 100 through the first and the second feedback line (FL1, FL2) is fed back thereto.

Here, the first common voltage supply line (BL1) is connected to an output terminal (O) of the common voltage compensating circuit 150 through a first output line (OL1) formed on the FPCB 135 and main PCB 140, and a lower end portion thereof is connected to a lower end portion of the first feedback line (FL1) in a U-shaped form. Furthermore, an upper end portion of the first feedback line (FL1) is connected to an input terminal (I) of the common voltage compensating circuit 150 through a first input line (IL1) formed on the FPCB 135 and main PCB 140.

Furthermore, the second common voltage supply line (BL2) is connected to an output terminal (O) of the common voltage compensating circuit 150 through a second output line (OL2) formed on the FPCB 135 and main PCB 140, and a lower end portion thereof is connected to a lower end portion of the second feedback line (FL2) in a U-shaped form. Furthermore, an upper end portion of the second feedback line (FL2) is connected to an input terminal (I) of the common voltage compensating circuit 150 through a second input line (IL2) formed on the FPCB 135 and main PCB 140.

The first and the second common voltage supply line (BL1, BL2) and the first and the second feedback line (FL1, FL2) may be formed on the same layer as the common line (CL) in the liquid crystal display panel 100, and a line width and thickness of the first and the second common voltage supply line (BL1, BL2) may be formed greater than that of the first and the second feedback line (FL1, FL2) within a possible range.

According to the foregoing structure, the common voltage compensating circuit 150 applies a common voltage (Vcom) to both sides of the liquid crystal display panel 100 through the output terminal (O), and the common voltage (Vcom) is transferred to each pixel region without having a signal deviation between both sides of the liquid crystal display panel 100 at both ends of each common line (CL) by the first and the second common voltage supply line (BL1, BL2). Furthermore, the common voltage (Vcom) applied through the first and the second feedback line (FL1, FL2) is fed back to compensate the common voltage (Vcom), thereby stably supplying the common voltage (Vcom).

A gate driving voltage applied to the gate line (GL) turns on a thin-film transistor (T) of each pixel region, and a data voltage (Vdata) is supplied at the same time to the data line (DL) through the thin-film transistor (T) and thus the data voltage is applied to a second electrode of the liquid crystal capacitor (LC), and the common voltage (Vcom) is applied to a first electrode of the liquid crystal capacitor (LC) through the common line (CL), thereby implementing an image by an electric field formed between the two electrodes.

For another embodiment having a more stable characteristic, it may be also applicable thereto a structure in which a plurality of common voltage compensating circuits 150 are provided and different common voltage compensating circuits are connected to the first common voltage supply line (BL1) and second common voltage supply line (BL2) to compensate a common voltage (Vcom) according to different signal delay characteristics between both side ends of the liquid crystal display panel 100.

On the other hand, a common voltage compensating circuit and a liquid crystal display device including the same according to the foregoing first embodiment may improve a signal deviation between the left and right common lines of the liquid crystal display panel 100, but there is a limit that a signal deviation between the top and bottom common lines of the liquid crystal display panel 100 cannot be improved.

Due to a large-sized liquid crystal display panel 100, the width increases in the left and right direction as well as in the top and bottom direction, and thus a common voltage applied from the top portion may cause a signal deviation problem due to a RC delay of the line as it is applied to the bottom portion.

Hereinafter, according to another embodiment, a liquid crystal display device for improving a signal deviation occurred between common lines at the top and bottom portions of the liquid crystal panel based on a location provided with a common voltage compensating circuit will be described with reference to the drawing.

Figure 4A:
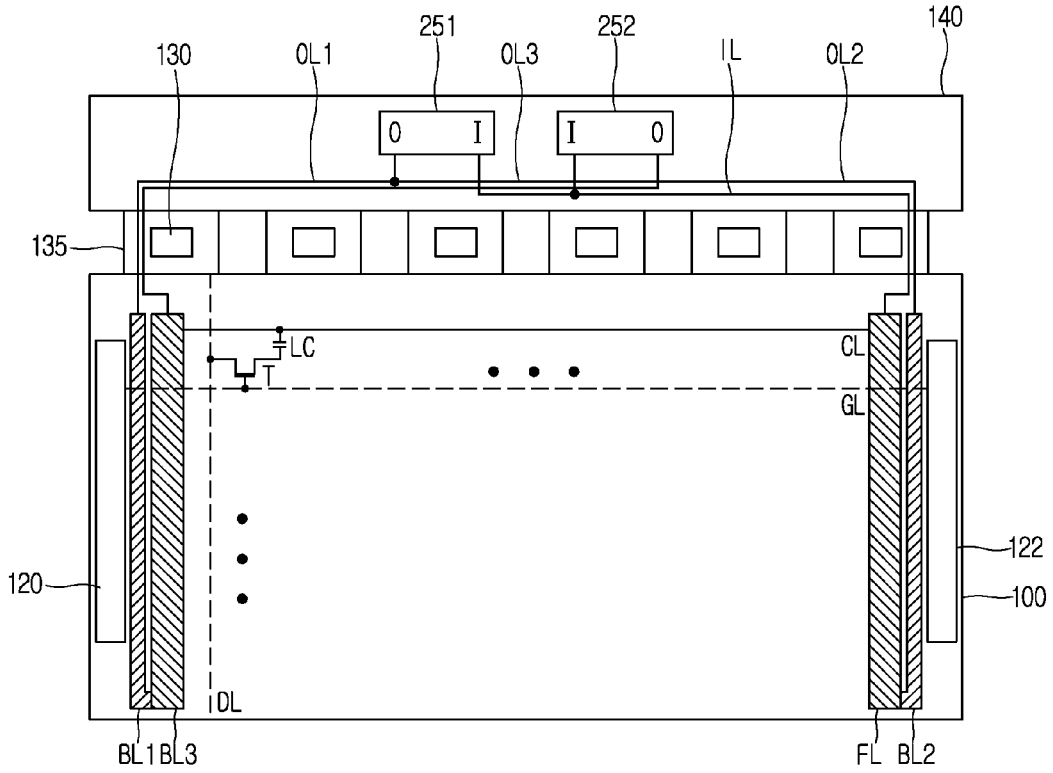
FIG. 4A is a view illustrating a common voltage compensating circuit according to a second embodiment of the present invention and a liquid crystal display device including the same.

FIG. 4A is a view illustrating a common voltage compensating circuit according to a second embodiment of the present invention and a liquid crystal display device including the same.

As illustrated in the drawing, a liquid crystal display device according to a second embodiment of the present invention may include a liquid crystal display panel 100 in which gate driving units 120, 122 are mounted at both side ends thereof and a first through a third common voltage supply line (BL1-BL3) and a feedback line (FL) are formed thereon, a plurality of FPCBs 135 connected to a side end of the liquid crystal display panel 100 and mounted with a data driving unit 130, a main PCB 140 connected to the FPCB 135 in a direction opposite to the liquid crystal display panel 100, and a first and a second common voltage compensating circuit 251, 252 mounted on the main PCB 140.

In particular, the structure of a liquid crystal display panel 100 according to a second embodiment of the present invention is similar to that of the foregoing first embodiment, and may be characterized in that two common voltage compensating circuits 251, 252 are provided and a connecting structure between the liquid crystal display panel 100 and the common voltage compensating circuit is changed, thereby improving a voltage deviation between the top and bottom common lines.

The liquid crystal display panel 100 is mounted with two gate driving units 120, 122 at both side ends thereof, respectively, one for each side end, and a plurality of gate lines (GLs) and data lines (DLs) are crossed with each other to define pixel regions at an inner side thereof. A thin-film transistor (T) and a liquid crystal capacitor (LC) are formed at each pixel region. Furthermore, a plurality of common lines (CLs) are formed in parallel to the gate lines (GLs).

The gate driving units 120, 122 sequentially supply a gate driving voltage to the gate lines (GLs) for each horizontal period (1H) according to a plurality of gate control signals applied from a timing controller (not shown). Furthermore, the data driving unit 130 supplies a data voltage to the liquid crystal display panel 100 in response to a data control signal applied from the timing controller.

The first and the second common voltage compensating circuit 251, 252 receive a power voltage (VDD) to generate a first common voltage (Vcom1) and a second common voltage (Vcom2) with a predetermined voltage level for driving the liquid crystal display panel 100. The first and the second common voltage (Vcom) are applied to the common line (CL) formed on the liquid crystal display panel 100, and the first through the third common voltage supply lines (BL1-BL3) connected to the common line (CL), and the feedback line (FL) connected to an end of the second common voltage supply line (BL2) are formed at both side ends of the liquid crystal display panel 100. The first common voltage compensating circuit 251 is electrically connected to the first and the second common voltage supply line (BL1, BL2) to supply the common voltage (Vcom) to the common line (CL), and the second common voltage compensating circuit 252 is electrically connected to the third common voltage supply line (BL3) to supply the common voltage to the common line (CL). Furthermore, the common voltage (Vcom) applied through the feedback line (FL) is fed back to each of the common voltage compensating circuits 251, 252.

Here, the first and the second common voltage supply line (BL1, BL2) is connected to an output terminal (O) of the first and the second common voltage compensating circuit 150, respectively, through a first and a second output line (OL1, OL2) formed on the FPCB 135 and main PCB 140, and the third common voltage supply line (BL3) is connected to an output terminal (O) of the second common voltage compensating circuit 252 through a third output line (OL3). Furthermore, the feedback line (FL) is connected to an input terminal (I) of the first and the second common voltage compensating circuit 251, 252 through an input line (IL) thereof.

Here, the structure of the liquid crystal display panel 100 is similar to that of the foregoing first embodiment, and accordingly the first through the third common voltage supply lines (BL1-BL3) and feedback line (FL) may be formed on the same layer as the common line (CL) in the liquid crystal display panel 100, and a line width and thickness of the third common voltage supply line (BL3) and feedback line (FL) may be formed greater than that of the first and the second common voltage supply lines (BL1, BL2) within a possible range.

According to the foregoing structure, the first common voltage compensating circuit 251 applies a common voltage (Vcom) to the first and the second common voltage supply line (BL1, BL2) at both sides of the liquid crystal display panel 100 to supply the common voltage (Vcom) through the common line (CL) in the bottom to top direction of the liquid crystal display panel 100.

At the same time, the second common voltage compensating circuit 252 applies a common voltage (Vcom) to the third common voltage supply line (BL3) to supply the common voltage (Vcom) through the common line (CL) in the top to bottom direction of the liquid crystal panel.

Accordingly, the first and the second common voltage compensating circuits 251, 252 apply a common voltage (Vcom) to the common line (CL) in each region of the liquid crystal display panel 100 in different sequences, and a RC delay to the common line (CL) corresponds to the voltage applied sequence, and thus a signal deviation between common lines can be improved by differently setting a compensation ratio of the common voltage compensating circuit.

As an example, when an output of the common voltage (Vcom) of the first common voltage compensating circuit 251 is set such that an upper region of the liquid crystal display panel 100 becomes its reference, the first common voltage compensating circuit 251 applies a common voltage in the bottom to top direction of the liquid crystal display panel 100, and accordingly, a compensation ratio of the lower region is higher than that of the upper region, thereby disallowing the compensation of the upper region. At this time, when an output of the common voltage (Vcom) of the second common voltage compensating circuit 252 is set such that an upper region of the liquid crystal display panel 100 becomes its reference, the second common voltage compensating circuit 252 applies a common voltage in the top to bottom direction of the liquid crystal display panel 100, and thus a compensation shortage portion by the first common voltage compensating circuit 251 is cancelled out by the second common voltage compensating circuit 252, thereby minimizing a deviation between the top and bottom regions of the liquid crystal display panel 100.

As a result, it may be possible to improve a deviation problem of the common voltage between the top and bottom regions of the liquid crystal display panel 100 with the same structure as in the related art. Hereinafter, various examples of a common voltage compensating circuit provided in a liquid crystal display device according to the foregoing second embodiment will be described with reference to the drawings.

CASE 1

Figure 4B:
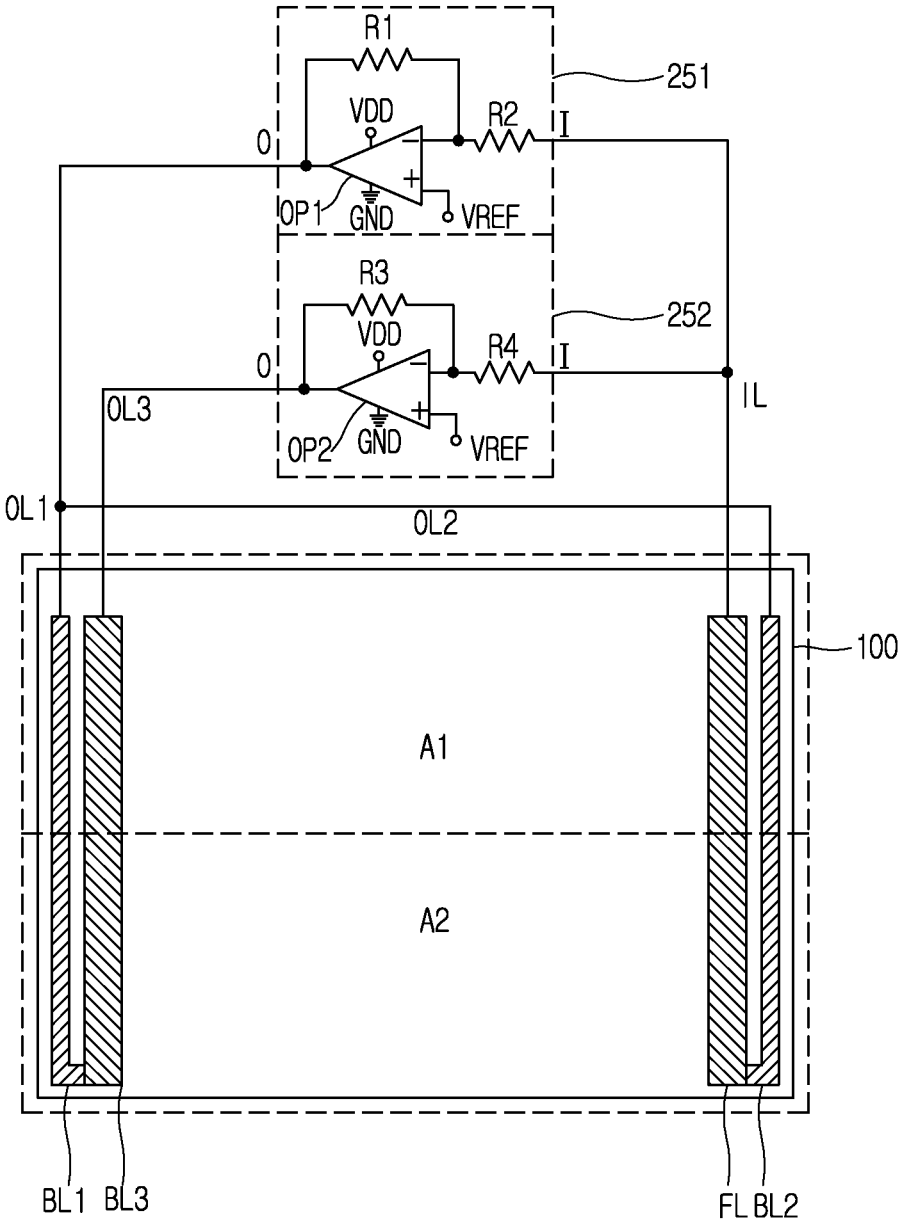
FIG. 4B is a view illustrating the CASE 1 of the example of a common voltage compensating circuit for a liquid crystal display device according to a second embodiment of the present invention.

FIG. 4B is a view illustrating the CASE 1 of the example of a common voltage compensating circuit for a liquid crystal display device according to a second embodiment of the present invention.

As illustrated in the drawing, a common voltage compensating circuit according to the present invention is configured with an amplifier circuit using a plurality of operation amplifiers, and the common voltage compensating circuit may include a first common voltage compensating circuit 251 configured to output a compensated common voltage (Vcom) to the first and the second common voltage supply lines (BL1, BL2) and a second common voltage compensating circuit 252 configured to output a compensated common voltage (Vcom) to the third common voltage supply line (BL3) with a structure in which each of the first and the second common voltage compensating circuit 251, 252 receives a common voltage (Vcom) fed back from the liquid crystal display panel 100 through one feedback line (FL).

The liquid crystal display panel 100 has the same structure as in the foregoing first embodiment but the function of each line is different, and more specifically, the first and the second feedback line (FL1, FL2 in FIG. 3) are connected to the first and the second output line (OL1, OL2) to be operated as the first and the second common voltage supply line (BL1, BL2), and the first common voltage supply line (BL1 in FIG. 3) is operated as a third common voltage supply line (BL3), and the second common voltage supply line (BL2 in FIG. 3) is operated as a feedback line (FL1).

Furthermore, the first common voltage compensating circuit 251 may include a first input resistor (R1), a second input resistor (R2), and a first operational amplifier (OP1).

The first operational amplifier (OP1) may include a non-inverting input terminal (+) and an inverting input terminal (−), and the output terminal (O) is connected to the first and the second output line (OL1, OL2), and the input terminal (I) is connected to the input line (IL) through the second input resistor (R2).

Furthermore, a reference voltage (VREF) is applied to the non-inverting input terminal (+) of the first operational amplifier (OP1). A capacitor for maintaining a level of the reference voltage (VREF) may be further provided in the non-inverting input terminal (+). Furthermore, a power voltage and a ground voltage (VDD, GND) for driving the first operational amplifier (OP1) may be applied to the first operational amplifier (OP1).

The first input resistor (R1) is connected in parallel to the output terminal (O) and inverting input terminal (−) of the first operational amplifier (OP1), and an end of the second input resistor (R2) is connected to the inverting input terminal (−) of the first operational amplifier (OP1), and the other terminal thereof is connected to the input terminal (IL).

According to the foregoing structure, a closed loop gain of the first operational amplifier (OP1) is determined by a ratio of the second input resistor (R2) and the first input resistor (R1). A first common voltage output (Vcom1) according to a close loop gain of the first operational amplifier (OP1) is defined in the following Equation 1.

$$V\text{com}1 = R1/R2 \quad \text{[Equation 1]}$$

Furthermore, the second common voltage compensating circuit 252 may include a third input resistor (R3), a fourth input resistor (R4), and a second operational amplifier (OP2).

The second operational amplifier (OP2) may include a non-inverting input terminal (+) and an inverting input terminal (−), and the output terminal (O) is connected to the third output line (OL3), and the input terminal (I) is connected to the input line (IL) through the fourth input resistor (R4). Furthermore, a reference voltage (VREF) is applied to the non-inverting input terminal (+) of the second operational amplifier (OP2).

The third input resistor (R3) is connected in parallel to the output terminal (O) and inverting input terminal (−) of the second operational amplifier (OP2), and an end of the fourth input resistor (R4) is connected to the inverting input terminal (−) of the second operational amplifier (OP2), and the other terminal thereof is connected to the input terminal (IL).

According to the foregoing structure, a closed loop gain of the second operational amplifier (OP2) is determined by a ratio of the fourth input resistor (R4) and the third input resistor (R3). A second common voltage output (Vcom2) according to a close loop gain of the second operational amplifier (OP2) is defined in the following Equation 2.

$$V\text{com}2 = R3/R4 \quad \text{[Equation 2]}$$

According to the foregoing structure, a deviation between regions can be minimized by controlling an output of the operational amplifier (OP1, OP2) of the first and the second common voltage compensating circuit 251, 252 in response to a deviation of the common voltage between the first region (A1) and second region (A2) of the liquid crystal display panel 100.

As an example, when a compensated common voltage output of the first common voltage compensating circuit 251 is set based on the second region (A2), the first region (A1) is set to have a relatively low compensation ratio of the common voltage, and at this time, the resistance values of the third and the fourth input resistor (R3, R4) of the second common voltage compensating circuit 252 are controlled based on Equation 2 and set to have a higher value than that of the Vcom2 to increase a compensation ratio of the first region (A1), thereby minimizing a deviation between each region.

Figure 1:
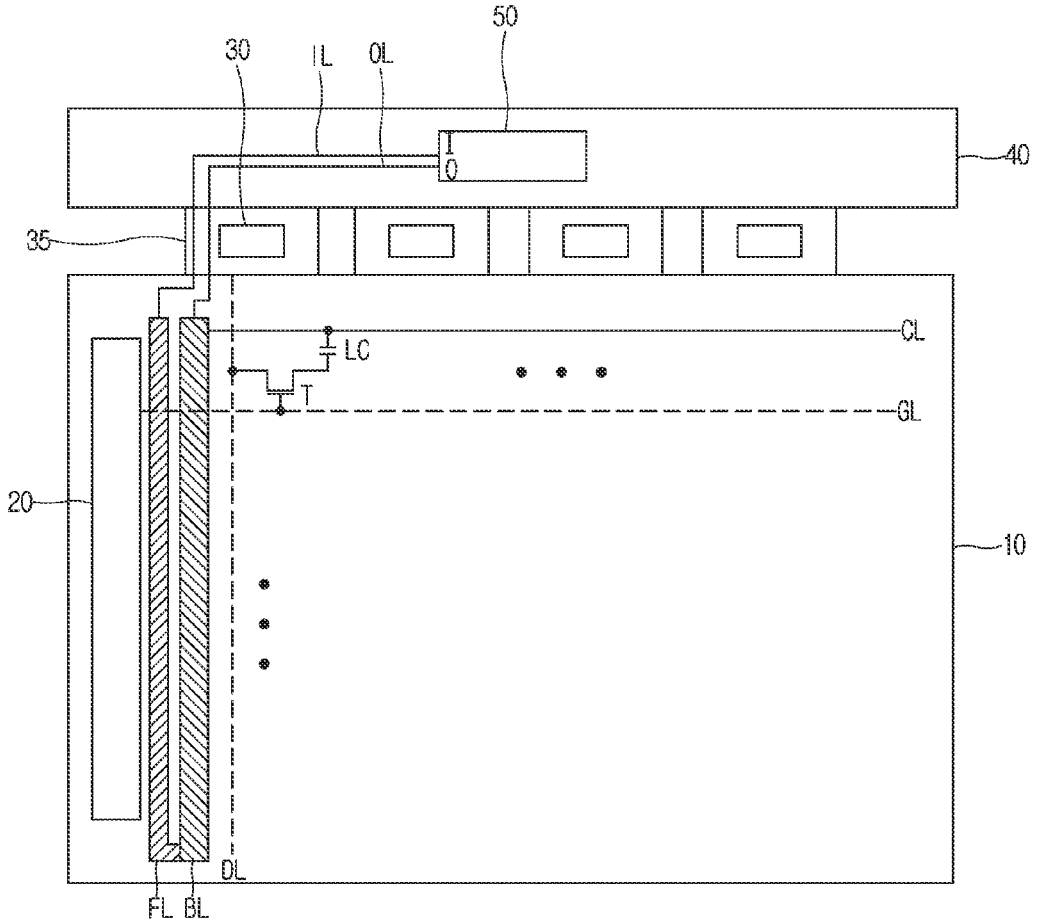
FIG. 1 RELATED ART
FIG. 1 is a view illustrating an example of a typical liquid crystal display device.
Figure 2:
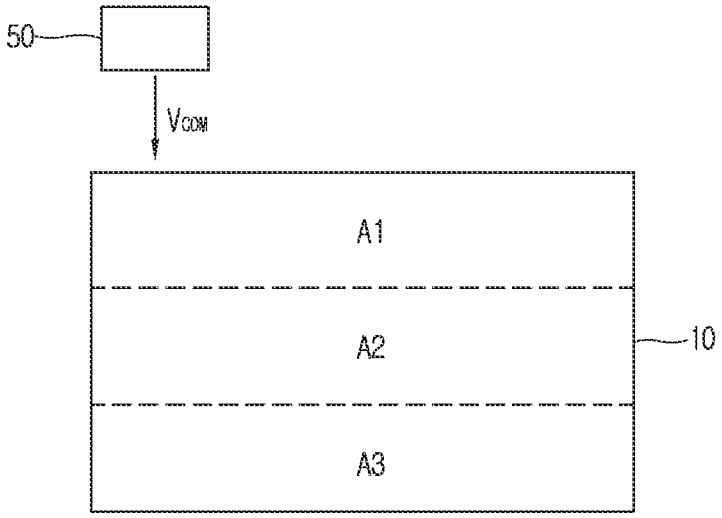
FIG. 2 RELATED ART
FIG. 2 is a view for explaining a deviation of the common voltage occurred according to a region of the liquid crystal display panel in a liquid crystal display device in the related art.

Furthermore, though not shown in the drawing, when the liquid crystal display panel is divided into three regions in the top and bottom direction as illustrated in FIG. 2, a common voltage compensating circuit including one operational amplifier may be further provided and common voltage compensation ratios are differently set to three regions, thereby compensating a deviation thereof.

Hereinafter, CASE 2 in which common voltage compensation ratios are differently set to two regions through one operational amplifier according to the second embodiment will be described with reference to the drawing.

CASE 2

Figure 4C:
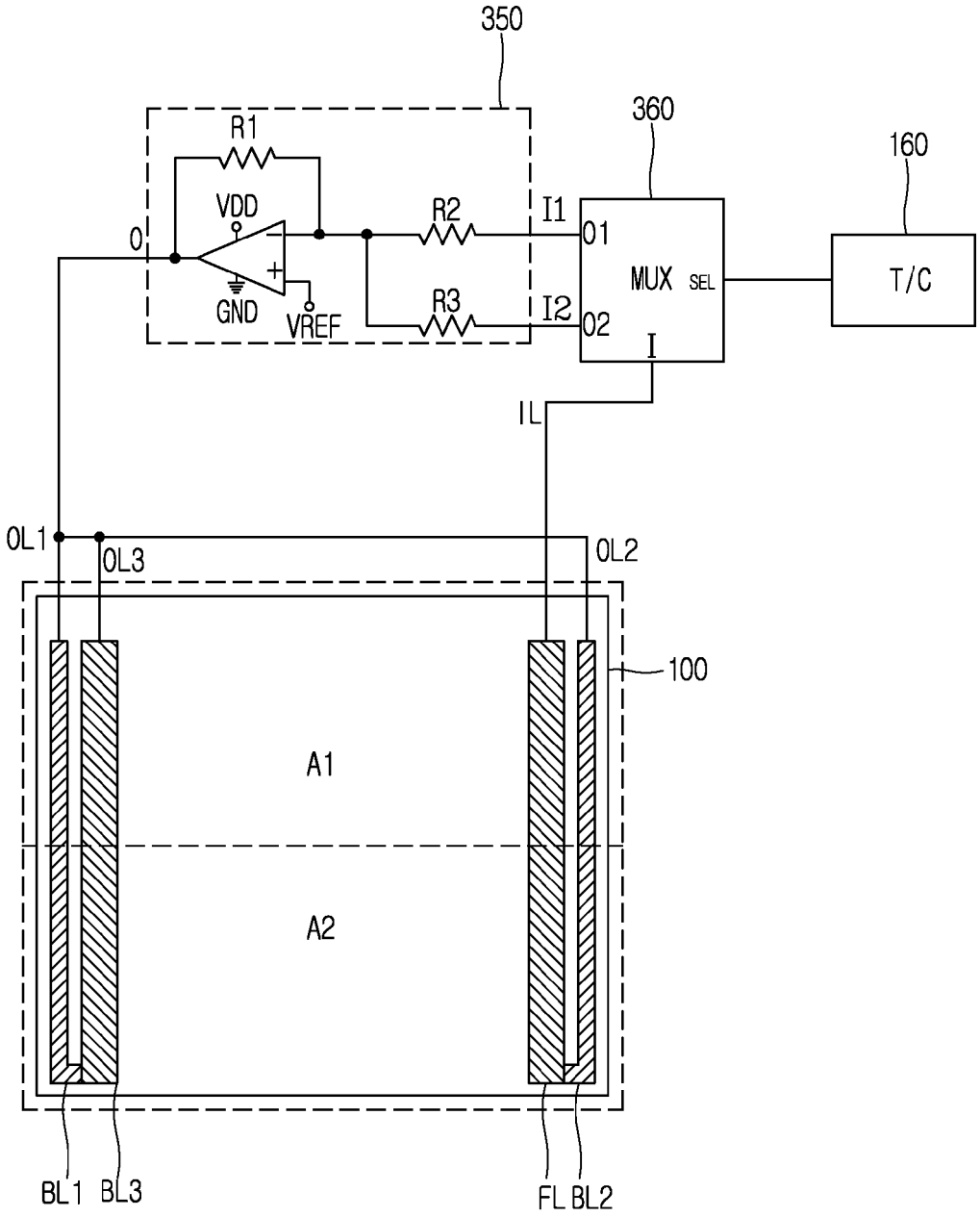
FIG. 4C is a view illustrating the CASE 2 of the example of a common voltage compensating circuit for a liquid crystal display device according to a second embodiment of the present invention.

FIG. 4C is a view illustrating the CASE 2 of the example of a common voltage compensating circuit for a liquid crystal display device according to a second embodiment of the present invention.

Referring to FIG. 4C, a common voltage compensating circuit according to the present invention is configured with an amplifier circuit using one operational amplifier, and has a structure in which a common voltage compensating circuit 350 for time-dividing a compensated common voltage (Vcom) for each region and outputting to the first through the third common voltage supply line (BL1-BL3) receives a common voltage (Vcom) fed back from the liquid crystal display panel 100 through one feedback line (FL).

The liquid crystal panel 100 has the same structure and function as in an example of having the foregoing common voltage supply circuit.

The common voltage compensating circuit 350 may include a first input resistor (R1) through a third input resistor (R3), and an operational amplifier (OP), and connected to a multiplexer (MUX) 360.

The operational amplifier (OP) may include a non-inverting input terminal (+) and an inverting input terminal (−), and the output terminal (O) is connected to the first and the third output line (OL1-OL3), and the input terminals (I1, I2) are connected to the output terminals (O1, O2) of the multiplexer 360 through the second and the third input resistor (R2, R3).

Furthermore, a reference voltage (VREF) is applied to the non-inverting input terminal (+) of the operational amplifier (OP). The first input resistor (R1) is connected in parallel to the output terminal (O) and inverting input terminal (−) of the operational amplifier (OP), and ends of the second and the third input resistor (R2, R3) are connected to the inverting input terminal (−) of the operational amplifier (OP), and the other ends thereof are connected to the output terminals (O1, O2) of the multiplexer (MUX), respectively. As a result, the second and the third input resistor (R2, R3) are connected in parallel to each other.

According to the foregoing structure, a closed loop gain of the operational amplifier (OP) is determined by a ratio of the second and the third input resistor (R2, R3) and the first input resistor (R1).

The multiplexer 360 is a 2×1 multiplexer in which the input terminal (I) thereof is connected to the feedback line (FL) through the input line (IL), and the two output terminals (O1, O2) thereof are connected to the second and the third input resistor (R2, R3), respectively. Furthermore, a selecting terminal (SEL) of the multiplexer 360 is connected to a timing controller (T/C) 160.

The timing controller 160 controls such that either one of two outputs of the multiplexer 360 is selected according to a timing signal input from the outside. In other words, the timing controller outputs a common voltage (Vcom) fed back through either one of the output terminals of the multiplexer 360 for each ½ frame through either one of the first input terminal (I1) and the second input terminal (I2) of the common voltage compensating circuit 350, and thus the compensation ratios of the common voltage (Vcom) between one frame are set in an different manner.

As an example, during a first ½ frame of the one frame, when the common voltage output of the common voltage compensating circuit 350 determines a resistance value of the second input resistor (R2) to set the second region (A2) to a reference, the first region (A1) is set to have a low compensation ratio of the common voltage. However, during the second ½ frame, when a resistance value of the third input resistor (R3) of the second common voltage compensating circuit 252 is determined to have a higher value than that of the first region (A1), a common voltage compensation ratio of the first region (A1) is set to have a lower value, thereby cancelling out the shortage compensation ratio of the first ½ frame. In other words, each compensation ratio between regions is time-divided and controlled to alternately have a high common voltage compensation ratio between the regions, thereby minimizing the deviation.

Furthermore, though not shown in the drawing, when the liquid crystal panel is divided into n regions (n is a natural number) in the top and bottom direction as illustrated in FIG. 2, a common voltage compensation ratio for n regions is time-divided to compensate the deviation by further including n input resistors and replacing it with an n×1 multiplexer.

Hereinafter, a still another embodiment in which a common voltage compensating circuit according to the second embodiment is set to have different common voltage compensation ratios in three regions through one operational amplifier will be described with reference to the drawing.

CASE 3

Figure 4D:
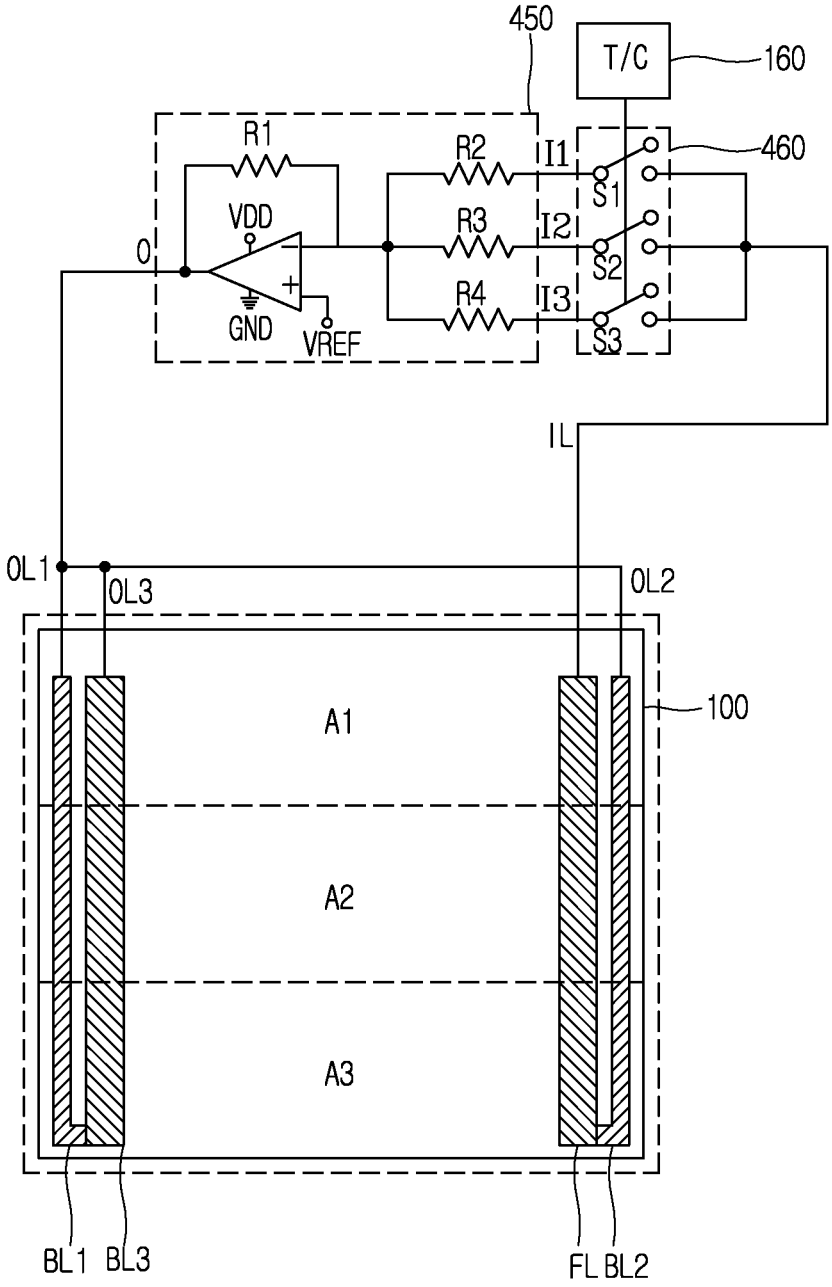
FIG. 4D is a view illustrating the CASE 3 of the example of a common voltage compensating circuit for a liquid crystal display device according to a second embodiment of the present invention.

FIG. 4D is a view illustrating the CASE 3 of the example of a common voltage compensating circuit for a liquid crystal display device according to a second embodiment of the present invention.

As illustrated in FIG. 4D, a common voltage compensating circuit 450 according to the present invention is configured with an amplifier circuit using one operational amplifier, and has a structure in which a common voltage compensating circuit 450 for time-dividing a compensated common voltage (Vcom) for each region and outputting to the first through the third common voltage supply line (BL1-BL3) receives a common voltage (Vcom) fed back from the liquid crystal panel 100 through one feedback line (FL).

The liquid crystal display panel 100 has the same structure and function as in an example of having the foregoing two common voltage supply circuits.

The common voltage compensating circuit 450 may include a first input resistor (R1) through a fourth input resistor (R4), and an operational amplifier (OP), and connected to a switching unit 460.

The operational amplifier (OP) may include a non-inverting input terminal (+) and an inverting input terminal (−), and the output terminal (O) is connected to the first and the third output line (OL1-OL3), and the input terminals (I1-I3) are connected to the switching unit 460 through each input resistor (R2-R4).

Furthermore, a reference voltage (VREF) is applied to the non-inverting input terminal (+) of the operational amplifier (OP). The first input resistor (R1) is connected in parallel to the output terminal (O) and inverting input terminal (−) of the operational amplifier (OP), and ends of the second through the fourth input resistor (R2-R4) are connected to the inverting input terminal (−) of the operational amplifier (OP), and the other ends thereof are connected to the output terminals (I1-I3) of the switching unit 460, respectively. As a result, the second through the fourth input resistor (R2-R4) are connected in parallel to each other.

According to the foregoing structure, a closed loop gain of the operational amplifier (OP) is determined by a ratio of any one of the second, the third, and the fourth input resistor (R2, R3, R4) and the first input resistor (R1).

The switching unit 460 is configured with a plurality of switches (S1-S3) an end of which is connected to the feedback line (FL) through the input line (IL), and the other end of which is connected to any one of the second, the third, and the fourth input resistor (R2, R3, R4). Furthermore, each switch (S1-S3) is connected to a timing controller (T/C) 160.

The timing controller 160 turns on any one of switches in the switching unit 460 according to a timing signal input from the outside. In other words, the timing controller outputs a common voltage (Vcom) fed back through the switching unit 460 for each ⅓ frame through any one of the first input terminal (I1) through the third input terminal (I3) of the common voltage compensating circuit 450, and thus the compensation ratios of the common voltage (Vcom) between one frame are set in an different manner.

As an example, during a first ⅓ frame of the one frame, the resistance values of the second and the third input resistor (R2, R3) are determined for a compensated common voltage output of the common voltage compensating circuit 450 such that the compensation ratios of the common voltage are set to be sequentially low in the first and the second region (A1, A2) by setting the third region (A3) to a reference, and set to be higher in each of the first and the second region (A1, A2) during the remaining frame period, and thus each compensation ratio for regions is time-divided into three regions and controlled to alternately have a high common voltage compensation ratio, thereby minimizing the deviation.

Furthermore, though not shown in the drawing, when the liquid crystal display panel is divided into n regions (n is a natural number) in the top and bottom direction as illustrated in FIG. 2, a common voltage compensation ratio for n regions is time-divided to compensate the deviation by further including n input resistors and further providing the corresponding n switches.

Hereinafter, a common voltage compensating circuit and liquid crystal display device including the same according to a third embodiment of the present invention will be described with reference to the drawing. In the following description, an example of minimizing a common voltage deviation between regions in the liquid crystal panel through one common voltage compensating circuit will be described, and the common voltage compensating circuit in the foregoing CASES 1-3 will be applicable in a similar manner.

Figure 5:
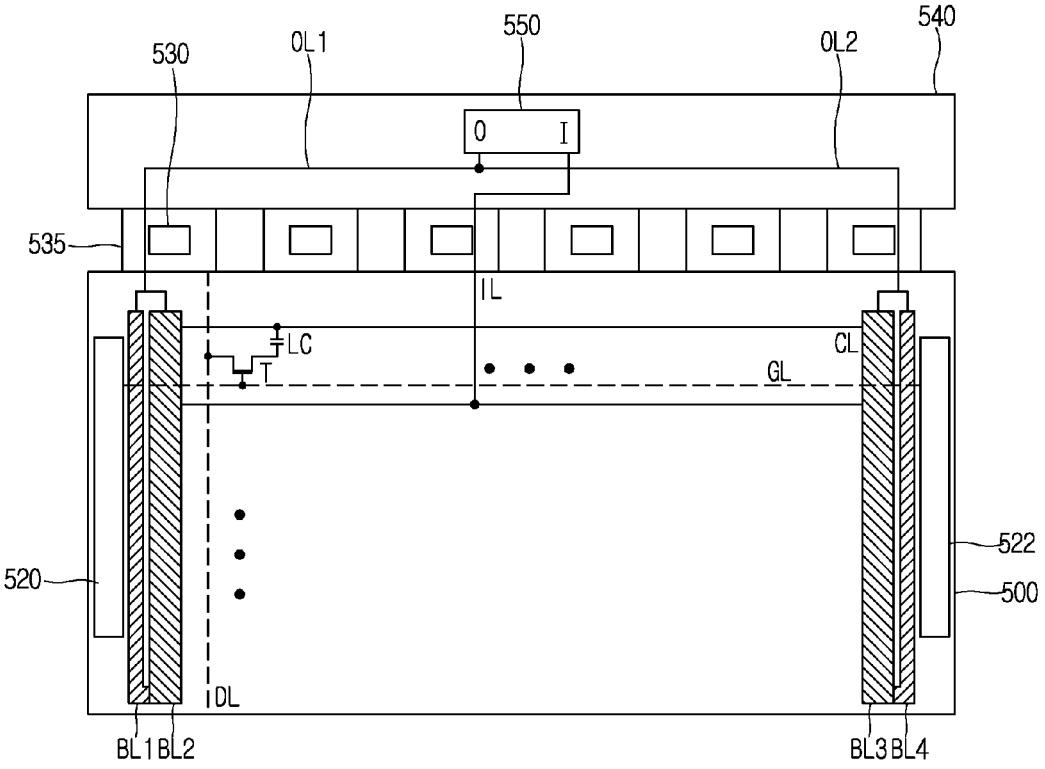
FIG. 5 is a view illustrating a common voltage compensating circuit according to a third embodiment of the present invention and a liquid crystal display device including the same.

FIG. 5 is a view illustrating a common voltage compensating circuit according to a third embodiment of the present invention and a liquid crystal display device including the same.

As illustrated in the drawing, a liquid crystal display device according to a third embodiment of the present invention may include a liquid crystal display panel 500 in which gate driving units 520, 522 are mounted at both side ends thereof and a plurality of common voltage supply lines (BL1-BL4) are formed thereon, a plurality of FPCBs 535 connected to a side end of the liquid crystal panel 500 and mounted with a data driving unit 530, a main PCB 540 connected to the FPCB 535 in a direction opposite to the liquid crystal display panel 500, and a common voltage compensating circuit 550 mounted on the main PCB 540.

In particular, the structure of a liquid crystal display panel 500 according to a third embodiment of the present invention is similar to that of the foregoing second embodiment, and may be characterized in that the common voltage compensating circuit similar to the foregoing embodiment is provided and a connecting structure between the liquid crystal display panel 500 and the common voltage compensating circuit is changed, thereby improving a voltage deviation between the top and bottom common lines.

The liquid crystal display panel 500 is mounted with two gate driving units 520, 522 at both side ends thereof, respectively, two for each side end, and a plurality of gate lines (GLs) and data lines (DLs) are crossed with each other to define pixel regions at an inner side thereof. A thin-film transistor (T) and a liquid crystal capacitor (LC) are formed at each pixel region. Furthermore, a plurality of common lines (CLs) are formed in parallel to the gate lines (GLs).

The gate driving units 520, 522 sequentially supply a gate driving voltage to the gate lines (GLs) for each horizontal period (1H) according to a plurality of gate control signals applied from a timing controller (not shown). Furthermore, the data driving unit 530 supplies a data voltage to the liquid crystal display panel 500 in response to a data control signal applied from the timing controller.

The common voltage compensating circuit 550 receives a power voltage (VDD) to generate a common voltage (Vcom) with a predetermined voltage level for driving the liquid crystal display panel 500. The common voltage (Vcom) is transferred to the common line (CL) formed on the liquid crystal display panel 500, and the first through the fourth common voltage supply line (BL1-BL4) connected to the common line (CL) are formed at both side ends of the liquid crystal display panel 500.

Furthermore, the common voltage compensating circuit 550 is electrically connected to each common voltage supply line (BL1-BL4) to apply the common voltage (Vcom) to the common line (CL). In particular, the common voltage (Vcom) applied through two common voltage supply lines (BL2, BL3) connected to the common line (CL) among the common voltage supply lines (BL1-BL4) other than a separately provided feedback line is fed back to the common voltage compensating circuits 550.

Here, the structure of the liquid crystal display panel 500 is similar to that of the foregoing first embodiment, but all the first through the fourth common voltage supply line (BL1-BL4) is connected to the common voltage compensating circuit 550, and a line width and thickness of the common voltage supply lines (BL2, BL3) connected to the common line (CL) may be formed greater than that of the other common voltage supply lines (BL1, BL4) within a possible range.

According to the foregoing structure, the common voltage compensating circuit 550 applies a common voltage (Vcom) to the common voltage supply lines (BL1-BL4) formed at both sides of the liquid crystal display panel 500 to supply the common voltage (Vcom) through the common line (CL) at the same time in both the top and bottom directions of the liquid crystal display panel 500.

Accordingly, the common voltage compensating circuit 550 applies a common voltage (Vcom) to the common line (CL) in each region of the liquid crystal display panel 500 in both directions, and a RC delay to the common line (CL) in each region corresponds to the voltage applied sequence, and thus common voltage compensation ratios between regions may be substantially the same, thereby improving a signal deviation between common lines.

Furthermore, the common voltage compensating circuit 550 receives a feedback of the common voltage through any one of the common lines (CLs), thereby obtaining an advantage that the configuration of an additional feedback line is not required for the liquid crystal panel.

Hereinafter, a common voltage compensating circuit and liquid crystal display device including the same according to a fourth embodiment of the present invention will be described with reference to the drawing. In the following description, an example of minimizing a common voltage deviation between regions in the liquid crystal display panel through one common voltage compensating circuit will be described, and the common voltage compensating circuit in the CASES 1-3 will be applicable similarly to the foregoing third embodiment.

Figure 6:
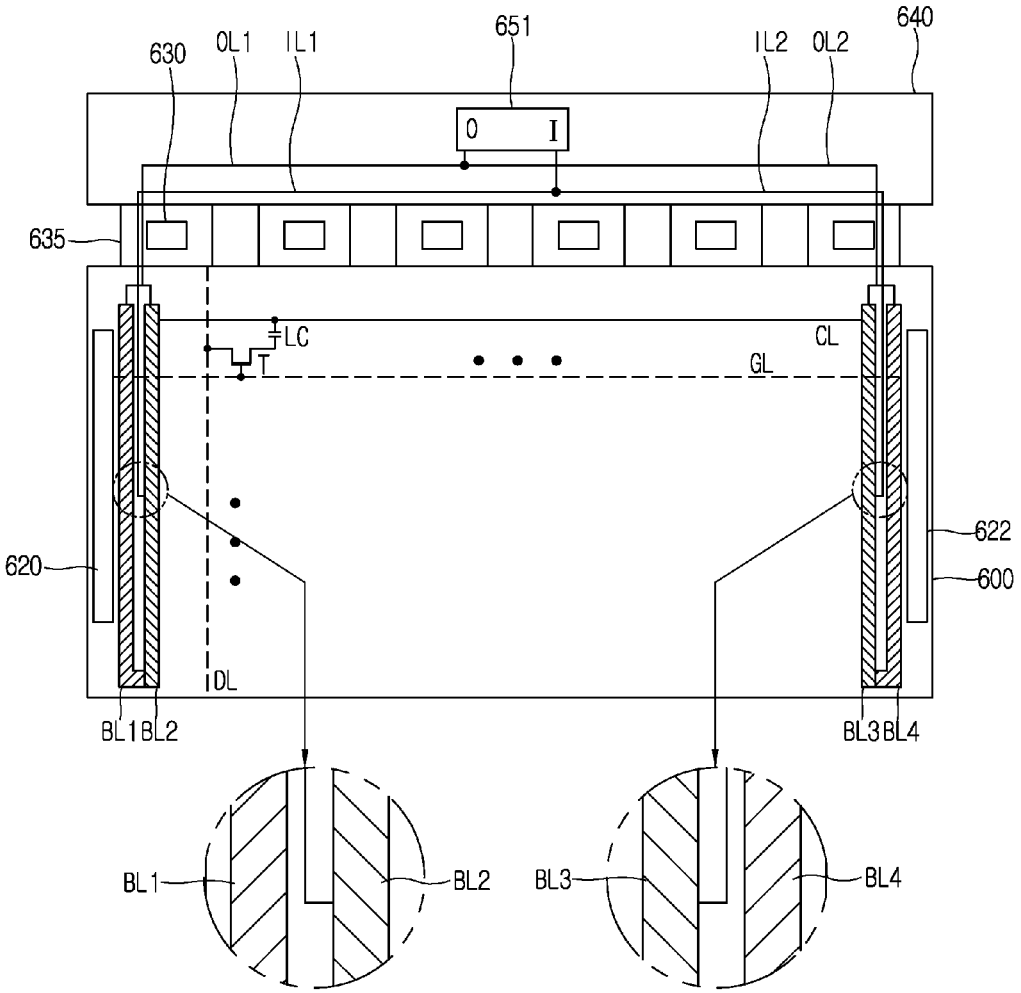
FIG. 6 is a view illustrating a common voltage compensating circuit according to a fourth embodiment of the present invention and a liquid crystal display device including the same.

FIG. 6 is a view illustrating a common voltage compensating circuit according to a fourth embodiment of the present invention and a liquid crystal display device including the same.

As illustrated in the drawing, a liquid crystal display device according to a fourth embodiment of the present invention may include a liquid crystal panel 600 in which gate driving units 620, 622 are mounted at both side ends thereof and a plurality of common voltage supply lines (BL1-BL4) are formed thereon, a plurality of FPCBs 635 connected to a side end of the liquid crystal display panel 600 and mounted with a data driving unit 630, a main PCB 640 connected to the FPCB 635 in a direction opposite to the liquid crystal display panel 600, and a common voltage compensating circuit 650 mounted on the main PCB 640.

In particular, a liquid crystal display panel 600 according to a fourth embodiment of the present invention has a structure in which a width between the common voltage supply lines (BL1-BL4) is the same, and a connecting structure between the liquid crystal display panel 600 and the common voltage compensating circuit is changed, thereby improving a voltage deviation between the top and bottom common lines.

The liquid crystal panel 600 is mounted with two gate driving units 620, 622 at both side ends thereof, respectively, two for each side end, and a plurality of gate lines (GLs) and data lines (DLs) are crossed with each other to define pixel regions at an inner side thereof. A thin-film transistor (T) and a liquid crystal capacitor (LC) are formed at each pixel region. Furthermore, a plurality of common lines (CLs) are formed in parallel to the gate lines (GLs).

The gate driving units 620, 622 sequentially supply a gate driving voltage to the gate lines (GLs) for each horizontal period (1H) according to a plurality of gate control signals applied from a timing controller (not shown). Furthermore, the data driving unit 630 supplies a data voltage to the liquid crystal display panel 600 in response to a data control signal applied from the timing controller.

The common voltage compensating circuit 650 receives a power voltage (VDD) to generate a common voltage (Vcom) with a predetermined voltage level for driving the liquid crystal display panel 600. The common voltage (Vcom) is transferred to the common line (CL) formed on the liquid crystal display panel 600, and the first through the fourth common voltage supply line (BL1-BL4) having the same width connected to the common line (CL) are formed at both side ends of the liquid crystal display panel 600.

Furthermore, the common voltage compensating circuit 650 is electrically connected to each common voltage supply line (BL1-BL4) to apply the common voltage (Vcom) to the common line (CL). In particular, the common voltage (Vcom) applied through two common voltage supply lines (BL2, BL3) connected to the common line (CL) among the common voltage supply lines (BL1-BL4) other than a separately provided feedback line is fed back to the common voltage compensating circuits 650.

Here, the input lines (IL1, IL2) for feedback are connected to the second and the third common voltage supply line (BL2, BL3), respectively, by auxiliary lines disposed between the first and the second common voltage supply line (BL1, BL2) and between the third and the fourth common voltage supply line (BL3, BL4) without being connected to the common line (CL).

According to the foregoing structure, the common voltage compensating circuit 650 applies a common voltage (Vcom) to the common voltage supply lines (BL1-BL4) formed at both sides of the liquid crystal display panel 600 to supply the common voltage (Vcom) through the common line (CL) at the same time in both the top and bottom directions of the liquid crystal display panel 600.

Accordingly, the common voltage compensating circuit 650 applies a common voltage (Vcom) to the common line (CL) in each region of the liquid crystal display panel 600 in both directions, and a RC delay to the common line (CL) in each region corresponds to the voltage applied sequence, and thus common voltage compensation ratios between regions may be substantially the same, thereby improving a signal deviation between common lines.

Furthermore, the first and the second input lines (IL1, IL2) are disposed at the outside of the liquid crystal display panel 600 without being disposed at the center of the liquid crystal panel to reduce the aperture ratio, and disposed at a separated space between the common voltage supply lines (BL1-BL4), thereby obtaining an advantage that the reduction of the aperture ratio is minimized, and the configuration of an additional feedback line is not required for the liquid crystal display panel 600.

Although many subject matters have been specifically disclosed in the foregoing description, they should be construed as an illustration of preferred embodiments rather than a limitation to the scope of invention. Consequently, the invention should not be determined by the embodiments disclosed herein but should be determined by the claims and the equivalents thereof.

What is claimed is:

1. A liquid crystal display device, comprising:

a liquid crystal display panel comprising a first and a second common voltage supply line formed in a first direction at both side ends of the substrate, and at least one feedback line formed in the first direction and connected to the first common voltage supply line and/or the second common voltage supply line; and a third common voltage supply line formed in the first direction an end of which is connected to the other one of the first and the second common voltage supply line, wherein at least one common voltage compensating circuit is disposed at a side end of the liquid crystal display panel, the output terminal of which is connected to the other end of the first and the second common voltage supply line, and the input terminal of which is connected to the other end of the feedback line, wherein the at least one common voltage compensating circuit comprises a first common voltage compensating circuit and a second common voltage compensating circuit, and wherein the first and the second common voltage compensating circuit are set to have different voltage gains to each other.

2. The liquid crystal display device of claim 1, wherein an output terminal of the second common voltage compensating circuit is connected to the other end of the third common voltage supply line, and wherein an input terminal of the second common voltage compensating circuit is connected to the other end of the feedback line.

3. The liquid crystal display device of claim 1, wherein the first common voltage compensating circuit comprises:

a first input resistor;

a first operational amplifier comprising an inverting input terminal connected to the first input resistor, a non-inverting input terminal to which a reference common voltage is applied, and an output terminal; and a second resistor disposed between the inverting input terminal and the output terminal, and the second common voltage compensating circuit comprises:

a third input resistor;

a second operational amplifier comprising an inverting input terminal connected to the third input resistor, a non-inverting input terminal to which a reference common voltage is applied, and an output terminal; and a fourth resistor disposed between the inverting input terminal and the output terminal.

4. The liquid crystal display device of claim 1, further comprising:

a third common voltage supply line formed in the first direction an end of which is connected to at least one of the first and the second common voltage supply line; and a multiplexer an input terminal of which is connected to the feedback line, and a plurality of output terminals of which are connected to an input terminal of the common voltage compensating circuit and a selecting terminal of which is connected to a timing controller for selecting the output terminals in a 1/N (N is a natural number) frame period.

5. The liquid crystal display device of claim 1, further comprising:

a third common voltage supply line formed in the first direction an end of which is connected to at least one of the first and the second common voltage supply line, and a switching unit having N switches an end of which is connected to the feedback line, and the other end of which is connected to an input terminal of the common voltage compensating circuit to control an on/off operation thereof in 1/N (N is a natural number) frame period by a timing controller.

6. A liquid crystal display device, comprising:

a liquid crystal display panel comprising a first through a fourth common voltage supply line formed in a first direction at both side ends of the substrate, respectively, two for each side end, and a plurality of common lines formed in a second direction, ends of which are connected to the second and the third common voltage supply line, respectively;

wherein an output terminal of the at least one common voltage compensating circuit is connected to the other end of the first through the fourth common voltage supply line, and an input terminal of the at least one common voltage compensating circuit is electrically connected to at least one of the common lines.

7. The liquid crystal display device of claim 6, further comprising:

a multiplexer an input terminal of which is connected to at least one of the common lines, and a plurality of output terminals of which are connected to an input terminal of the common voltage compensating circuit and a selecting terminal of which is connected to a timing controller for selecting the output terminals in a 1/N (N is a natural number) frame period.

8. The liquid crystal display device of claim 6, further comprising:

a switching unit having N switches an end of which is connected to at least one of the common lines, and the other end of which is connected to an input terminal of the common voltage compensating circuit to control an on/off operation thereof in 1/N (N is a natural number) frame period by a timing controller.

9. A liquid crystal display device, comprising:

a liquid crystal display panel comprising a first through a fourth common voltage supply line formed in a first direction at both side ends of the substrate, respectively, two for each side end, and a plurality of common lines formed in a second direction, ends of which are connected to the second and the third common voltage supply line, respectively; and wherein an output terminal of the at least one common voltage compensating circuit is connected to the other ends of the first through the fourth common voltage supply line, and an input terminal of the at least one common voltage compensating circuit is electrically connected to a line disposed between the first and second common voltage supply lines and between the third and fourth common voltage supply lines.

10. The liquid crystal display device of claim 9, further comprising:

a multiplexer an input terminal of which is connected to an auxiliary line, and a plurality of output terminals of which are connected to an input terminal of the common voltage compensating circuit and a selecting terminal of which is connected to a timing controller for selecting the output terminals in a 1/N (N is a natural number) frame period.

11. The liquid crystal display device of claim 9, further comprising:

a switching unit having N switches an end of which is connected to the auxiliary line, and the other end of which is connected to an input terminal of the common voltage compensating circuit to control an on/off operation thereof in 1/N (N is a natural number) frame period by a timing controller.

* * * * *